United States Patent [19]

Brasky

[11] Patent Number: 4,480,175

[45] Date of Patent: Oct. 30, 1984

[54] DIRECTIONAL ELECTRICAL HEATING PANEL ASSEMBLY

[76] Inventor: Joseph L. Brasky, Tower Hill Rd., Killingworth, Conn. 06417

[21] Appl. No.: 418,613

[22] Filed: Sep. 16, 1982

[51] Int. Cl.[3] ..... H05B 3/28

[52] U.S. Cl. ..... 219/345; 174/58; 219/356

[58] Field of Search ..... 219/345, 350, 351, 353, 219/354, 356, 357; 220/3.2, 3.3, 3.4, 3.94; 174/53, 58; 338/77

[56] References Cited

U.S. PATENT DOCUMENTS

| | | | |
|---|---|---|---|
| 1,471,340 | 10/1923 | Knight | 220/3.94 |
| 1,949,337 | 2/1934 | Sharp | 220/3.4 |
| 2,209,146 | 7/1940 | Bessette | 174/58 |
| 3,001,054 | 9/1961 | Fehner | 219/345 |
| 3,400,247 | 9/1968 | Deacon | 219/356 |
| 3,448,246 | 6/1969 | Armbruster | 219/345 |
| 3,550,267 | 12/1970 | Williams | 219/345 |
| 3,594,545 | 7/1971 | Green | 219/345 |
| 3,598,960 | 8/1971 | Deacon | 219/213 |
| 3,664,013 | 5/1972 | MacGuire | 219/345 |
| 3,751,630 | 8/1973 | Brasky | 219/345 |

FOREIGN PATENT DOCUMENTS

| | | | |
|---|---|---|---|
| 2307640 | 8/1974 | Fed. Rep. of Germany | 219/345 |
| 215360 | 11/1940 | Switzerland | 219/345 |
| 816738 | 7/1959 | United Kingdom | 174/58 |

*Primary Examiner*—C. L. Albritton
*Assistant Examiner*—Geoffrey S. Evans
*Attorney, Agent, or Firm*—McCormick, Paulding & Huber

[57] ABSTRACT

An electrical heating panel assembly comprises two relatively thin and generally planar panels arranged in face-to-face relationship and in inner-outer relationship relative to a zone to be heated. The panels are adhesively secured together with the inner panel carrying a length of electrical resistance heating wire and a pair of cold leads connected with the heating wire and projecting outwardly from the panel face. The outer panel has a through opening receiving the cold leads and a junction box mounting plate is arranged in the through opening with a marginal flange secured between the panels. The mounting plate has a through opening receiving the cold leads and a junction box detachably secured to the plate has a bottom opening for receiving the leads. A power line also enters the box and is electrically connected with the cold leads therewithin in a parallel or series connection. The rear or outer panel may be of insulating material to enhance the directional characteristics of the inner panel and a third panel may be provided inwardly of the inner panel. The third panel may comprise a vinyl-like material, a coating of paint, or a pan which supports the first two panels and extends outwardly about the side edges thereof.

10 Claims, 11 Drawing Figures

DIRECTIONAL ELECTRICAL HEATING PANEL ASSEMBLY

BACKGROUND OF THE INVENTION

Electrical heating assemblies are gaining in commercial acceptance but retain certain disadvantages in directional characteristics and in ease and convenience in effecting a safe and secure power line connection.

It is the general object of the present invention to provide an electrical heating panel assembly with improved directional characteristics and an improved means for conveniently effecting a safe and secure power line connection.

SUMMARY OF THE INVENTION

In fulfillment of the foregoing object and in accordance with the present invention, an electrical heating panel assembly is provided with at least two relatively thin and generally planar panels arranged in face-to-face relationship and in inner outer relationship relative to a zone to be heated thereby. The panels are secured together as by adhesive means and the inner panel carrys a length of electrical resistance heating wire and a pair of cold leads connected with the heating wire project outwardly from the face of the inner panel. The outer panel has a through opening for receiving the cold leads and a junction box mounting plate is arranged in the through opening with a marginal flange disposed between the panels adjacent the opening. The flange and plate are held firmly in position by the panels and the adhesive or other means securing the panels together. A through opening in the mounting plate receives the cold leads and a junction box detachably connected to the mounting plate also has an opening for receiving the cold leads. The junction box projects outwardly from the outer panel and includes power line entry means for the introduction of at least a portion of a power supply line. In the interior of the junction box the power supply line is electrically connected with the cold leads for a safe and secure connection.

Preferably the electrical resistance heating wire is embedded in the inner panel although it may be disposed between the panels and adhesively secured in position. The inner panel is preferably of a gypsum-like wall board construction and the outer panel may vary widely in insulating and other properties but is also preferably of gypsum-like wall board construction.

A third relatively thin generally planar panel may also be provided in face-to-face relationship inwardly of and in engagement with the inner panel. The third panel may comprise a vinyl or vinyl-like material, a pan which is coextensive with the inner panel and which has outwardly projecting marginal portions adjacent the edge surfaces of the panel, or the inner panel may simply be provided with a suitable coating of paint.

The junction box may vary widely but is preferably of a conventional octagonal side wall construction with a through opening in the bottom wall thereof for introduction of the cold leads to the interior of the box. Conventional punch-out entry means and associated clamp means are provided for a power supply line and a parallel connection of the line with the cold leads is preferred.

When a conventional octagonal junction box is employed, a circular mounting plate with a continuous marginal flange is provided with a circular central opening. The flange is disposed between and secured in position by the panel edge portions adjacent the through opening in the outer panel and the circular opening in the plate receives the projecting cold leads. A portion of the plate disposed within the through opening in the outer panel supports and is detachably connected to the bottom wall of the junction box.

DESCRIPTION OF PREFERRED EMBODIMENTS

Figure 1:
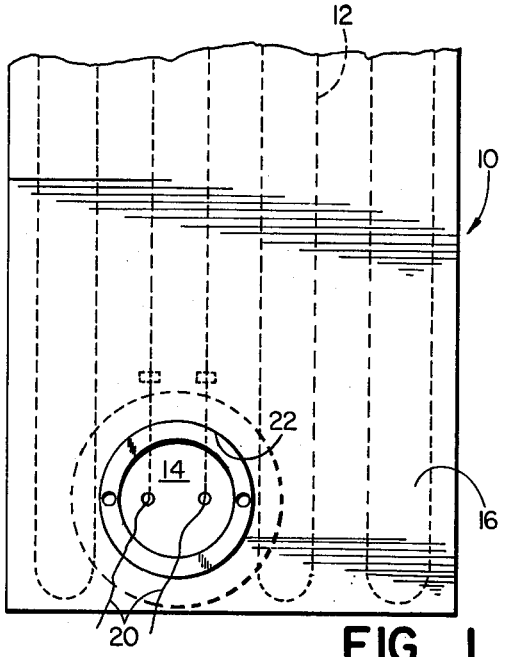
FIG. 1 is a fragmentary plan view of a heating panel assembly constructed in accordance with the present invention but with the junction box removed from its mounting plate.
Figure 3:
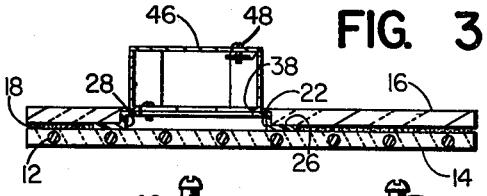
FIG. 3 is a vertical section taken generally as indicated at 3,3 in FIG. 2 and illustrating the relationship of the inner and outer panels, junction box mounting plate and the junction box, the power line and cold leads being eliminated for clarity of illustration.
Figure 4:
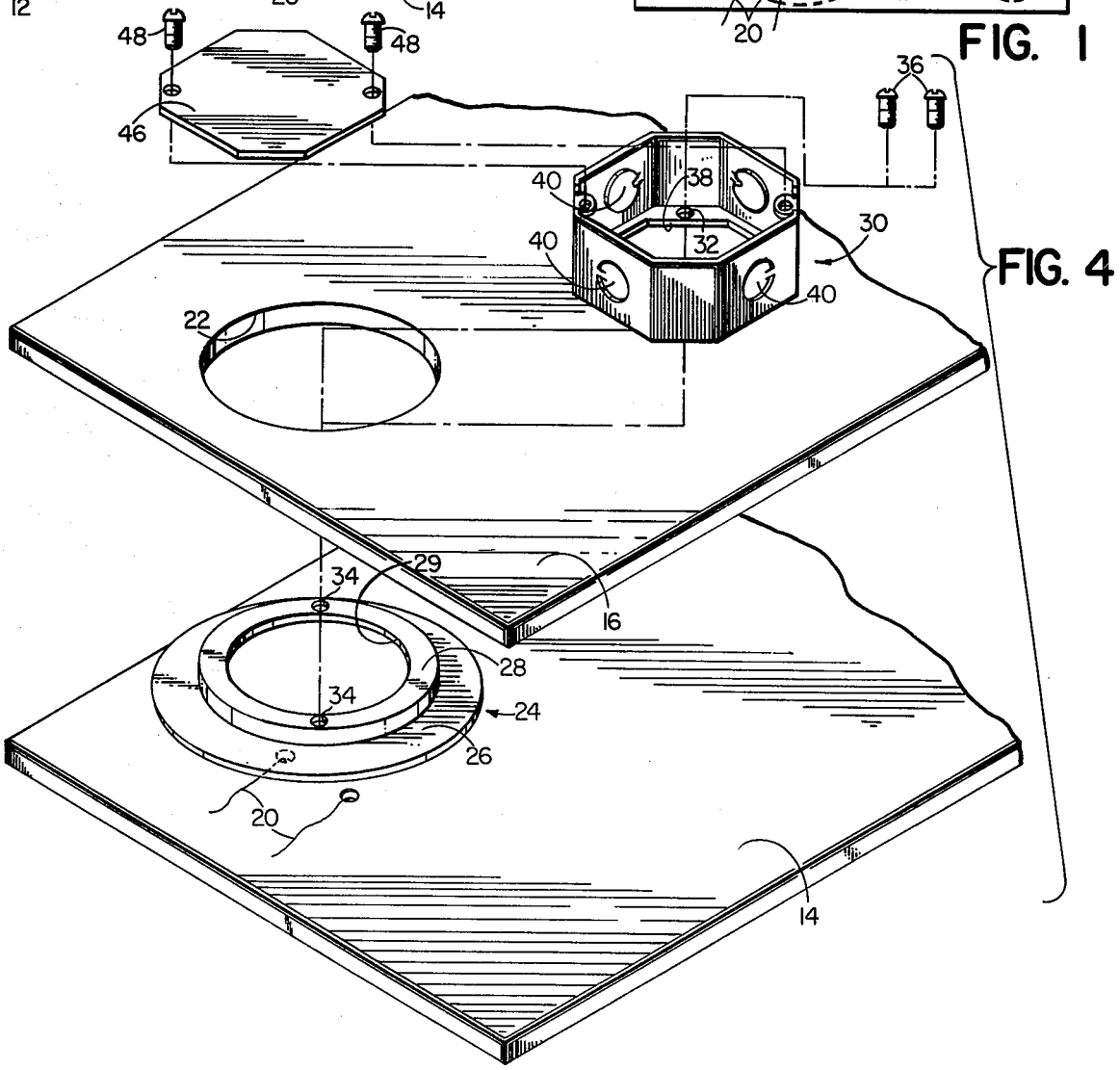
FIG. 4 is an exploded perspective view showing portions of inner and outer panels, a junction box mounting plate, and a junction box.

Referring particularly to FIG. 1, it will be observed that a heating panel assembly indicated generally at 10 takes a generally rectangular configuration in plan view with a generally sinusoidal arrangement of a heating wire indicated in broken line at 12. As best illustrated in FIG. 3, the heating wire 12 is embedded in a lowermost or inner panel 14 arranged beneath or inwardly of a second panel 16. In accordance with the invention, the heating wire 12 is carried by the inner or lower panel 14 and may be disposed atop the panel and between the panels 14,16, embedded in the panel 14 as shown, or otherwise arranged for radiating heat downwardly or inwardly in FIG. 3. The panel arrangement of FIG. 3 represents a ceiling installation of the heating panel assembly of the present invention but the attitude or orientation of the panel assembly does not form any part of the present invention. It should be noted however, that the two panels of FIG. 3 forming the assembly are arranged in inner-outer relationship and in face-to-face relationship. The inner or lower panel 14 is thus disposed inwardly with respect to the zone to be heated by the panel assembly, in the case of FIG. 3 a room or other zone beneath the panel assembly.

Figure 2:
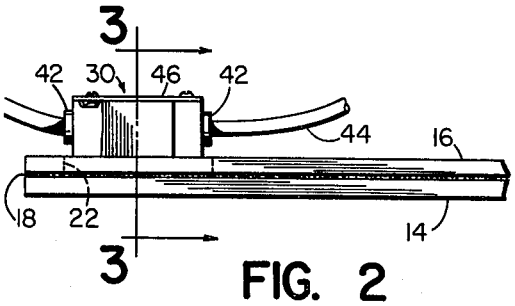
FIG. 2 is a side view of a portion of a heating panel assembly of the present invention with a junction box in position thereon and a portion of a power supply line associated therewith.

The two relatively thin and generally planar panels of the panel assembly are secured together as shown in FIGS. 2 and 3 by suitable means, and adhesive means is presently preferred as indicated at 18. The panels 14,16 are preferably coextensive and as illustrated, each of the panels is of a gypsum-like wall board construction, the upper or outer panel 16 serving an insulating function and tending to enhance the directional characteristics of the panel 14. That is, the downward or inward radiation of heat from the panel 14 is significantly improved with the addition of the panel 16 upwardly or outwardly thereof and in close face-to-face relationship therewith.

Reverting to FIG. 1, the electrical resistance heating wire 12 in panel 10 has connected thereto a pair of cold leads 20,20 which project outwardly from the inner panel 14. The outer panel 16 has a through opening 22, FIGS. 1-4, for receving the cold leads 20,20 in passage outwardly through the panel 16. The construction and arrangement of the heating wire and the associated cold leads may be conventional.

Preferably, and as illustrated, the opening 22 in the panel 16 is circular and has an associated junction box mounting plate 24 which is also of circular configuration when a circular opening 22 is provided. The plate 24 has a marginal flange 26 which is disposed between the panel 14,16 adjacent the opening 22 and which is held securly in position by the panels and by the adhesive or other means securing the panels togehter, FIG. 3. A raised central portion 28 of the mounting plate 24 has a through opening 29 and is disposed in and substantially fits the opening 22, FIGS. 3 and 4.

Further in accordance with the invention, a junction box is provided as at 30 for mounting on the junction box plate 24. The box 30 is detachably connected to the plate 24 and such connection may be effected by suitable screw openings 32,32 in the box, similar openings 34,34 in the mounting plate 24, and screws 36,36, FIG. 4. The junction box 30 projects upwardly or outwardly from the panel assembly 14,16 and has a bottom opening 38 therein communicating with the mounting plate opening 22 and receiving the cold leads 20,20 with all elements in assembled position as in FIG. 2. That is, the cold leads 20,20 project upwardly through the panel opening 22, the junction box mounting plate opening 29, the junction box opening 38, and into the interior of the box 30 in FIG. 2. The arrangement is similar in FIG. 3 but the cold leads are elminated for clarity of illustration.

In order to effect the necessary connection with a power line within the junction box 30, a power line entry means is provided in the box and may take the form of conventional punch-out elements 40,40. Further, conventional clamping means as at 42,42 in FIG. 2 may be employed to secure a power supply line 44 in the usual manner relative to the junction box 30. As shown, the power line 44 passes through the junction box 30 for a parallel connection of the cold leads with the power line in the interior of the box. Such connection may of course be conventional and is the preferred connection for the heating panel assembly of the present invention. A closure member or cover 46 may be provided with the usual attachment screws 48,48 and is of octagonal configuration when an octagonal junction box is employed as illustrated.

Figure 6:
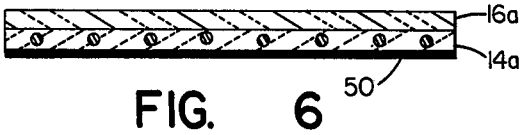
FIG. 6 is a vertical section taken generally as indicated at 6,6 in FIG. 5 and showing a first form of panel assembly comprising first and second panels with an inner or lowermost panel having electrical resistance heating wire embedded therein.
Figure 7:
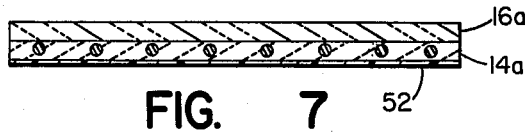
FIG. 7 is a vertical section taken generally as indicated at 7,7 in FIG. 5 but showing a slightly different form of panel assembly with a third panel disposed inwardly or beneath the resistance wire carrying panel and comprising a vinyl or vinyl-like material.
Figure 8:
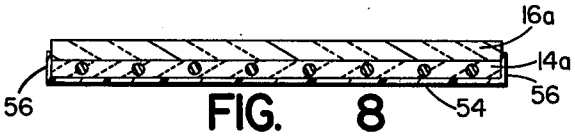
FIG. 8 is a vertical section taken generally as indicated at 8,8 in FIG. 5 and showing a further form of panel assembly wherein a pan-like third panel is provided inwardly or beneath the first two panels and in supporting relationship therewith.
Figure 5:
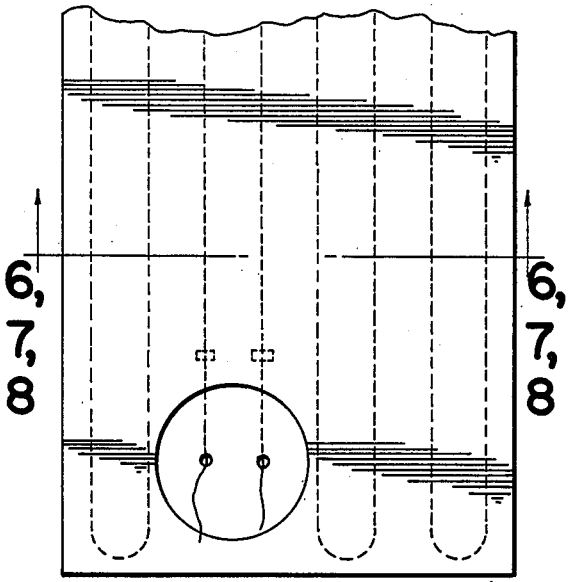
FIG. 5 is a plan view of a representative panel assembly viewed from the top in a ceiling installation with the junction box and its mounting plate eliminated.

In FIG. 5, a panel assembly indicated generally at **10*a* may take any one of the cross-sectional forms illustrated in FIGS. 6-8. That is, the FIG. 6 assembly comprises inner and outer panels 14*a* and 16*a* and may also comprise a third relatively thin and generally planar panel disposed inwardly of the panel 14*a* and merely comprising a coating of suitable paint as at 50** in FIG. 6.

In FIG. 7 inner and outer panels **14*a* and 16*a* may be provided with a third inwardly disposed panel 52** which may comprise a decorative vinyl-like material or various other materials employed for decorative or functional purposes.

In FIG. 8, inner and outer panels **14*a*,16*a* have an associated pan-like panel member 54 disposed inwardly thereof and having outwardly projecting marginal portions 56,56 adjacent and in engagement with the edge portions of the panels 14*a*,16*a*. The pan-like member 54 may serve as a structural or supporting member for the panels 14*a*,16*a***.

Figure 9:
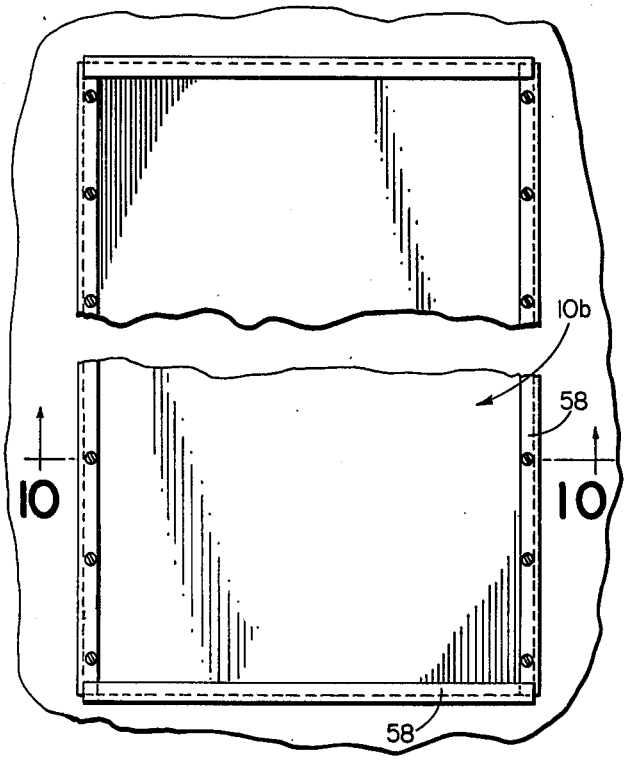
FIG. 9 is a plan view of a panel assembly comprising a further embodiment of the invention and including marginal supporting strips about the edges of the assembly for nailing or otherwise securing the assembly in operative position.
Figure 10:
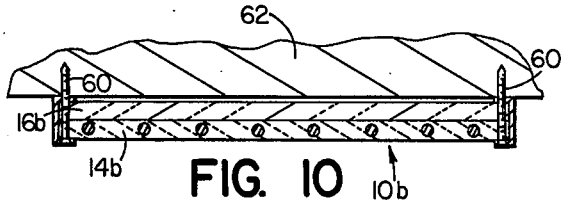
FIG. 10 is a vertical section taken generally as indicated at 10,10 in FIG. 9 and showing the panel assembly nailed in operative position in a ceiling installation.

FIGS. 9 and 10, a panel assembly **10*b* has inner and outer panels 14*b*, 16*b* and generally U-shaped marginal mounting members 58,58 thereabout. The members 58,58 provide a means for securing the panel assembly in position as in a ceiling installation where the panels are nailed in position by means of nails 60,60 projecting through the members, 58,58 and into a structural member 62**. Various other mounting means are of course contemplated within the scope of the invention.

Figure 11:
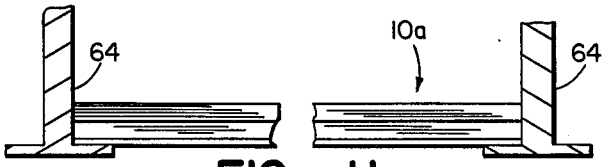
FIG. 11 is a vertical section through a panel assembly of the FIG. 7 type with a pair of support members in a drop ceiling installation.

In FIG. 11 a panel assembly such as the assembly **10*a* of FIG. 7 is shown supported by conventional T-bar members 64,64** in a hung ceiling installation.

In view of the foregoing, it will be apparent that the heating panel assembly of the present invention provides for improved directional heating characteristics and at the same time provides a convenient means for electrical connection. That is, the panel assemblies may be efficiently stack transported to the installation site in assembled condition with merely the junction box mounting plates secured in position or, alternatively, the junction boxes may be included in the assembly. At the installation site, in the first instance with the panels provided with mounting plates only, conventional junction boxes may be employed, and conveniently mounted in position atop or outwardly of the panel assemblies and the electrical connections may thereafter be readily effected in a safe and secure manner.

I claim:

1. An electrical heating panel assembly comprising at least two relatively thin and generally planar panels arranged in face-to-face relationship and in inner-outer relationship relative to a zone to be heated thereby, means securing said panels together, said inner panel carrying a length of electrical resistance heating wire and a pair of cold leads connected with the heating wire and projecting outwardly from the panel face, said outer panel having a through opening receiving said cold leads, a junction box mounting plate having a portion thereof arranged in and substantially fitting the wall of said through opening and having a marginal flange disposed between said panels adjacent said opening, said marginal flange and mounting plate being held firmly in position by entrapment of the flange by and between said panels and said means securing the panels together, and said mounting plate having a through opening in said portion which is arranged in the panel opening and through which said cold leads pass, a junction box associated with said mounting plate and having an opening for receiving said cold leads, means detachably connecting said junction box to said mounting plate with the box projecting outwardly from said outer panel and with the opening therein in communication with the mounting plate opening, said junction box and mounting plate when so connected electrically isolating said outer panel from the interior of the box and plate, power line entry means in said junction box for the introduction of at least a portion of a power supply line to the interior of said junction box for insulated electrical connection with said cold leads therewithin, an access opening at a top portion of said junction box opposite said cold lead opening, and a cover for said access opening in said junction box.

2. An electrical heating panel assembly as set forth in claim 1 wherein said electrical resistance heating wire is embedded in said inner panel, and wherein said inner panel is of a conventional gypsum-like wall-board construction.

3. An electrical heating panel assembly as set forth in claim 2 wherein said outer panel is of a conventional gypsum-like wall-board construction, and wherein said panel securing means comprises an adhesive disposed between and joining said panels together.

4. An electrical heating panel assembly as set forth in claim 1 and including a third relatively thin generally planar panel arranged in face-to-face relationship inwardly of and in engagement with said inner panel.

5. An electrical heating panel assembly as set forth in claim 4 wherein said third panel takes the form of a decorative vinyl-like material.

6. An electrical heating panel assembly as set forth in claim 4 wherein said third panel takes the form of a pan-like member coextensive with the inner face of said inner panel and extending outwardly at least partially about the edge surfaces thereof.

7. An electrical heating panel assembly as set forth in claim 1 wherein said power line entry means in said junction box provides for the through passage of the power line and the parallel electrical connection of the cold leads therewith.

8. An electrical heating panel assembly as set forth in claim 7 wherein said junction box is of a conventional construction with punch-out entry means and associated clamp means for the power supply line and an access cover detachably secured thereto opposite the opening for the cold leads.

9. An electrical heating panel assembly as set forth in claim 7 wherein said through opening in said outer panel is circular, wherein said mounting plate is circular with a portion thereof residing in and substantially fitting said panel opening, and wherein said junction box is generally octagonal in side wall configuration with the cold lead opening in a bottom wall thereof and said detachable connecting means operative between a bottom wall portion of the box and said portion of said junction box mounting plate which resides in the panel opening.

10. An electrical heating panel assembly as set forth in claim 9 wherein said heating wires are embedded in said inner panel with said cold leads projecting outwardly from an outer surface thereof through the opening in said outer panel, through said mounting plate opening, and into said junction box.

* * * * *